US009075325B2

(12) United States Patent
McGuire et al.

(10) Patent No.: US 9,075,325 B2
(45) Date of Patent: Jul. 7, 2015

(54) HIGH SPEED CHARGE TRANSPORT LAYER

(71) Applicant: XEROX CORPORATION, Norwalk, CT (US)

(72) Inventors: Gregory McGuire, Oakville (CA); Sarah J. Vella, Milton (CA); Adrien P. Cote, Clarkson (CA); Yvan Gagnon, Mississauga (CA); Brynn Dooley, Toronto (CA)

(73) Assignee: XEROX CORPORATION, Norwalk, CT (US)

( * ) Notice: Subject to any disclaimer, the term of this patent is extended or adjusted under 35 U.S.C. 154(b) by 108 days.

(21) Appl. No.: 14/018,413

(22) Filed: Sep. 4, 2013

(65) Prior Publication Data

US 2015/0064614 A1 Mar. 5, 2015

(51) Int. Cl.

| | |
|---|---|
| ***G03G 5/047*** | (2006.01) |
| ***G03G 5/04*** | (2006.01) |
| ***G03G 5/05*** | (2006.01) |
| ***G03G 5/06*** | (2006.01) |

(52) U.S. Cl.
CPC ..... *G03G 5/04* (2013.01); *G03G 5/0525* (2013.01); *G03G 5/0614* (2013.01)

(58) Field of Classification Search
CPC .... G03G 5/047; G03G 5/0614; G03G 5/0514
USPC ..... 430/58.05
See application file for complete search history.

(56) References Cited

U.S. PATENT DOCUMENTS

| | | | | |
|---|---|---|---|---|
| 3,121,006 | A | 2/1964 | Middleton | |
| 4,286,033 | A | 8/1981 | Neyhart | |
| 4,291,110 | A | 9/1981 | Lee | |
| 4,338,387 | A | 7/1982 | Hewitt | |
| 4,587,189 | A | 5/1986 | Hor | |
| 5,756,245 | A | 5/1998 | Esteghamatian | |
| 7,202,002 | B2 | 4/2007 | Tokarski | |
| 7,416,824 | B2 | 8/2008 | Kondoh | |
| 8,372,566 | B1 * | 2/2013 | Cote et al. | 430/56 |
| 8,765,340 | B2 * | 7/2014 | Vella et al. | 430/66 |
| 2011/0000324 | A1 | 1/2011 | Gamble | |

* cited by examiner

*Primary Examiner* — Hoa V Le
(74) *Attorney, Agent, or Firm* — Pillsbury Winthrop Shaw Pittman LLP

(57) ABSTRACT

A photoreceptor includes a substrate a charge generating layer disposed on the substrate and a charge transport layer disposed on the charge generating layer, the charge transport layer includes a hole transport molecule, a fluorinated diol, and a leveling agent, the charge transport layer is substantially free of a polymer binder and catalyst, and has a post-discharge voltage of less than about 10 volts.

10 Claims, 3 Drawing Sheets

HIGH SPEED CHARGE TRANSPORT LAYER

FIELD

Embodiments disclosed herein relate to photoreceptor members in an imaging apparatus. In particular, embodiments disclosed herein relate to compositions used in charge transport layers of photoreceptor members.

BACKGROUND

There is a continuing interest in improving the functional performance of xerographic photoreceptors. For example, it is generally desirable to reduce the post-discharge voltage of a photoreceptor and to minimize changes in its electrical characteristics during prolonged electrical cycling. There is also an impetus to extend the life of the photoreceptor in order to reduce run costs. Achieving both of these goals simultaneously has been a challenge.

By way of example, incorporation of low wear, life-extending compositions, such as protective overcoats, cross-linking polymer binders, or low surface energy additives generally results in a reduction in average charge mobility throughout the photosensitive layers. This leads to an unwanted increase in post discharge surface voltage. To combat this problem, attempts have been made to identify higher mobility charge transport molecules for both charge transport layers and overcoat layers. Thus far, the increase in average mobility has been limited due to the solubility of the hole transport molecules in the photosensitive layers.

SUMMARY

Figure 1:
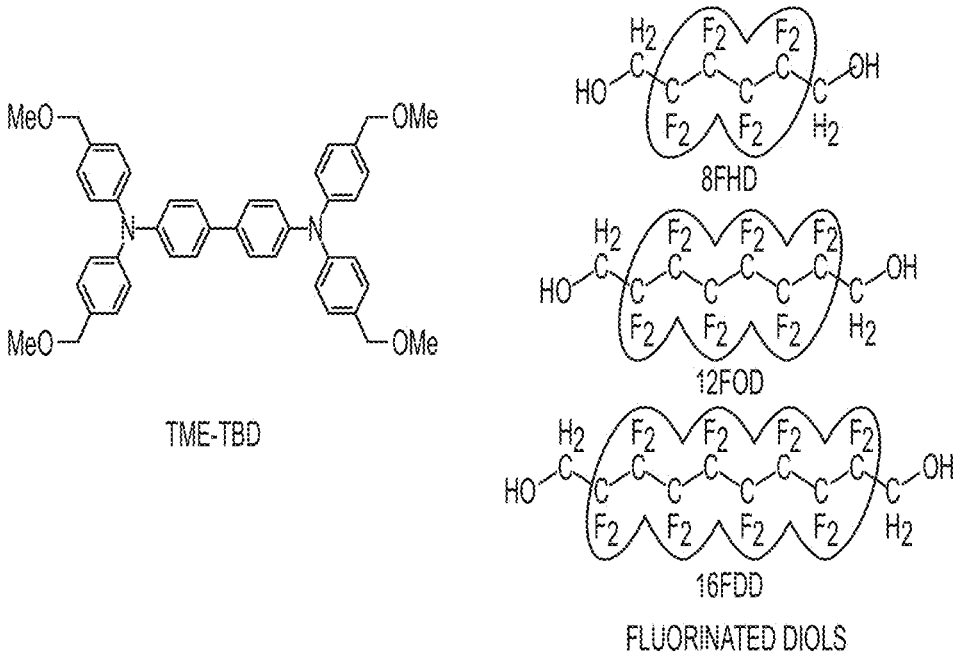
FIG. 1 shows chemical structures of components present in a charge transport layer, in accordance with an embodiment disclosed herein.

In some aspects, embodiments disclosed herein relate to photoreceptors comprising a substrate, a charge generating layer disposed on the substrate, and a charge transport layer disposed on the charge generating layer, the charge transport layer comprising a hole transport molecule, a fluorinated diol, and a leveling agent, wherein the charge transport layer is substantially free of a polymer binder and catalyst, and has a post-discharge voltage of less than about 10 volts.

In some aspects, embodiments disclosed herein relate to photoreceptors comprising a substrate, a charge generating layer disposed on the substrate, and a charge transport layer disposed on the charge generating layer, the charge transport layer comprising a hole transport molecule, a fluorinated diol, and a leveling agent, wherein the charge transport layer comprises a gradient crosslinked portion whereby the degree of crosslinking is greatest distal to the charge generating layer.

In some aspects, embodiments disclosed herein relate to methods of forming a charge transport layer comprising applying on a substrate a polymer binder-free and catalyst-free mixture comprising a hole transport molecule, a fluorinated diol, and a leveling agent, and curing the placed mixture.

DETAILED DESCRIPTION

Embodiments disclosed herein provide photoreceptor members comprising charge transfer layers (CTLs) prepared from mixtures of hole transport molecules and fluorinated diols. The CTL-forming compositions are notably prepared in the absence of bulk polymer binders and catalysts, both of which were determined to impair the performance of the charge transfer layer. When coated over a charge generating layer on a flexible substrate or rigid drum, the CTL-forming compositions disclosed herein produce a uniform, transparent and hard amorphous thin film coating that has excellent charging and discharging properties. The resultant charge transport layer is capable of a post-discharge voltage of 10 volts or less, making it suitable for use in combination with a low-wear overcoat. The low post-discharge voltage may compensate for the loss of average mobility due to the incorporation of the protective overcoat.

The charge transport layers disclosed herein are even suitable for use absent a separate low-wear protective overcoat. In some such embodiments, the ability to use the CTL disclosed herein absent a protective layer may be enhanced by surface modification. The charge transport layer can be crosslinked by treatment of the fully formed CTL with radiation, plasma, hydrogen bombardment, or a surface liquid catalyst treatment providing a highly controlled degree of cross-linking selectively at its surface. This crosslinking is present as a gradient which drops off quickly providing the requisite hardness and wear resistance where it is needed most, i.e. at the surface, while eliminating a sharp interface typical of conventional protective overcoat layers.

The CTL-forming compositions disclosed herein exhibit excellent coatability allowing easy formation of a transparent, uniform, hard coating that functions as the CTL with an average width of about 30 microns, though the exact width may be tuned as desired. Beneficially, the CTL can be formed without substantial observable crystallization providing exceptionally high discharge rates, allowing the use of lower mobility protective surface layers if so desired.

In embodiments, there are provided photoreceptors comprising a substrate, a charge generating layer disposed on the substrate, and a charge transport layer disposed on the charge generating layer, the charge transport layer comprising a hole transport molecule, a fluorinated diol, and a leveling agent, wherein the charge transport layer is substantially free of a polymer binder and catalyst, and has a post-discharge voltage of less than about 10 volts.

As used herein, "substantially free," when used to describe the absence of polymer binder and catalyst means less than about less than 0.5%, or less than about 0.05%, or less than about 0.001% by weight of the coating composition. Conventional polymer binders are generally not purposely added to the coating compositions disclosed herein. However, it will be understood by those skilled in the art that certain components of reagents, such as leveling agents, may contain some level of polymer material. Likewise, with regard to catalysts, embodiments disclosed herein include CTL surface treatments with acid catalysts to provide surface crosslinking. Although efforts to remove such acid catalysts may be provided, trace amounts of residual catalyst may remain. "Substantially free" means that any adventitious amount of polymer binder or catalyst that may be present does not rise to a level to effect the performance of the CTL, as measure by post discharge voltage.

As used herein, "post discharge voltage" refers to the measured surface voltage on the photoreceptor after the light exposure step in the xerographic cycle and this voltage is an indication of the photodischarge rate (i.e., the speed at which the surface voltage drops when exposed to light).

Figure 2:
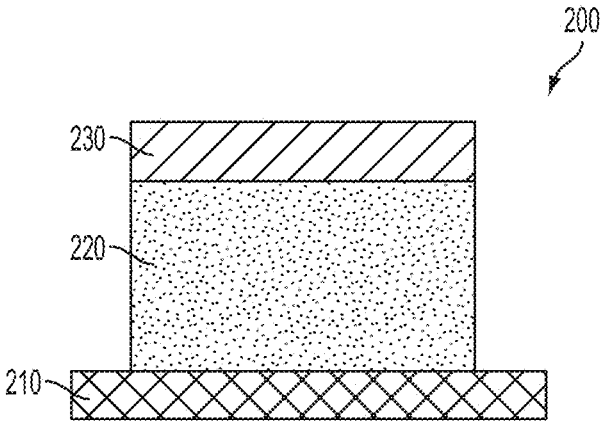
FIG. 2 shows the structure of a high speed photoreceptor having a charge transport layer (CTL), in accordance with embodiments disclosed herein, along with a protective overcoat.

Referring now to FIG. 2, there is shown a cross section of a portion of an exemplary photoreceptor member 200, in accordance with embodiments disclosed herein. Photoreceptor member 200 includes a substrate 210 having a charge transport layer 220 disposed thereon. An optional protective overcoat 230 is disposed on charge transport layer 220. Photoreceptor member 200 may include further layers disposed between or on top of any of the layers shown, as will be appreciated by those skilled in the art.

The Substrate

The photoreceptor substrate 210 may be opaque or substantially transparent, and may comprise any suitable organic or inorganic material having the requisite mechanical properties. The entire substrate 210 can comprise the same material or can be separated into a support portion and an electrically conductive surface portion, where such electrically conductive surfaces can be coated on to the support portion to form substrate 210. Any suitable electrically conductive material can be employed for this purpose, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

An exemplary substrate support portion is not soluble in any of the solvents used in each subsequent coating layer solution, is optically transparent or semi-transparent, and is thermally stable up to a high temperature of about 150° C. A substrate support portion of a substrate 210 used for imaging member fabrication may have a thermal contraction coefficient ranging from about 1×10−5 per ° C. to about 3×10−5 per ° C. and a Young's Modulus of between about 5×10−5 psi (3.5×10−4 Kg/cm2) and about 7×10−5 psi (4.9×10−4 Kg/cm2).

The substrate 210 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support portion of substrate 210 depends on numerous factors, including mechanical performance and economic considerations.

The substrate 210 may have a number of different configurations, such as for example, a plate, a cylinder, a drum, a scroll, an endless flexible belt, and the like. In the case of the substrate being in the form of a belt, the belt can be seamed or seamless. In embodiments, the photoreceptor herein may be in a drum configuration. The overall thickness of substrate 210 (whether monolithic or multilayered) depends on numerous factors, including flexibility, mechanical performance, and the like. The thickness of the support substrate 210 of the present embodiments may be at least about 500 micrometers, or less than about 3,000 micrometers, or be in a range from about 750 micrometers to about 2500 micrometers.

The Overcoat Layer

In embodiments, photoreceptor 200 further comprises an overcoat layer 230 disposed on charge transport layer 220. Optional overcoat layer 230, if desired, may be disposed over the charge transport layer 220 to provide the photoreceptor (imaging member) surface protection as well as improve resistance to abrasion. In embodiments, the overcoat layer 230 may have a thickness ranging from about 0.1 micrometer to about 15 micrometers or from about 1 micrometer to about 10 micrometers, or in a specific embodiment, about 3 micrometers to about 10 micrometers. Overcoating layer 230 may comprise a charge transport component and an optional organic polymer or inorganic polymer. Overcoat layer 230 may include thermoplastic organic polymers or cross-linked polymers such as thermosetting resins, UV or e-beam cured resins, and the likes. Overcoat layer 230 may further include a particulate additive such as metal oxides including alumina and silica, or low surface energy materials including polytetrafluoroethylene (PTFE), and combinations thereof.

Any known or new overcoat materials may be included for the present embodiments. In embodiments, overcoat layer 230 may include a charge transport component or a cross-linked charge transport component. In particular embodiments, for example, the overcoat layer comprises a charge transport component comprised of a tertiary arylamine containing substituent capable of self cross-linking or reacting with a polymer resin to form a cured composition. Specific examples of charge transport component suitable for overcoat layer 230 comprise the tertiary arylamine with a general formula of

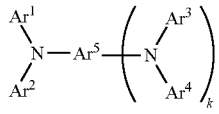

wherein $Ar^1$, $Ar^2$, $Ar^3$, and $Ar^4$ each independently represents an aryl group having about 6 to about 30 carbon atoms, $Ar^5$ represents aromatic hydrocarbon group having about 6 to about 30 carbon atoms, and k represents 0 or 1, and wherein at least one of $Ar^1$, $Ar^2$, $Ar^3$ $Ar^4$, and $Ar^5$ comprises a substituent selected from the group consisting of hydroxyl (—OH), a hydroxymethyl (—$CH_2OH$), an alkoxymethyl (—$CH_2OR$, wherein R is an alkyl having 1 to about 10 carbons), a hydroxylalkyl having 1 to about 10 carbons, and mixtures thereof. In other embodiments, $Ar^1$, $Ar^2$, $Ar^3$, and $Ar^4$ each independently represent a phenyl or a substituted phenyl group, and $Ar^5$ represents a biphenyl or a terphenyl group.

Additional examples of charge transport component which comprise a tertiary arylamine include the following:

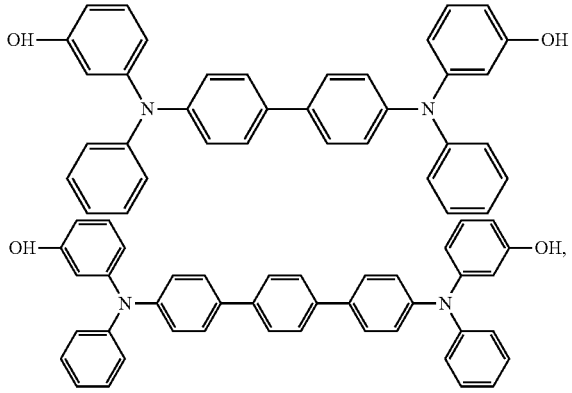

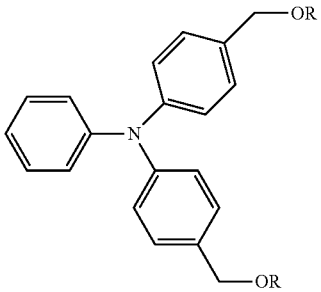

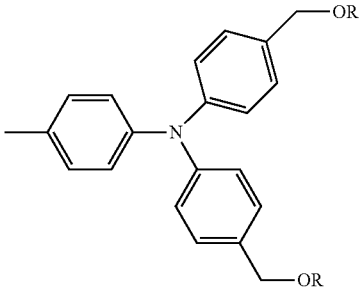

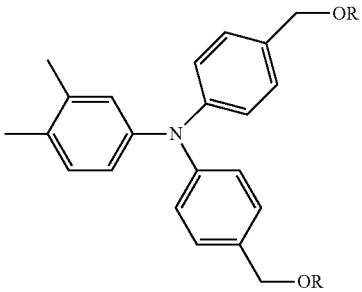

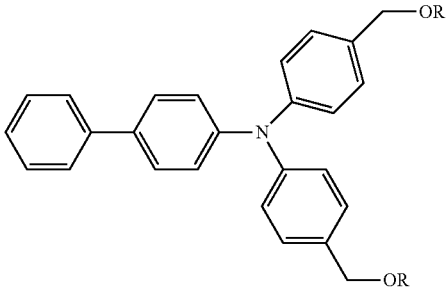

-continued

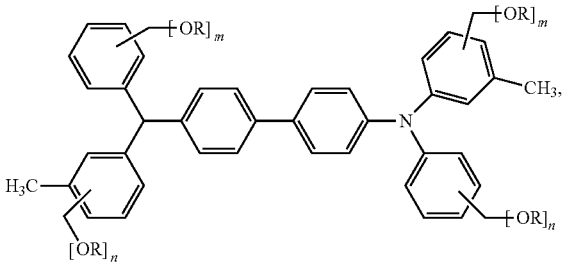

and the like, wherein R is a substituent selected from the group consisting of hydrogen atom, and an alkyl having from 1 to about 6 carbons, and m and n each independently represents 0 or 1, wherein m+n>1. In specific embodiments, the overcoat layer may include an additional curing agent to form a cured, crosslinked overcoat composition. Illustrative examples of the curing agent may be selected from the group consisting of a melamine-formaldehyde resin, a phenol resin, an isocyalate or a masking isocyalate compound, an acrylate resin, a polyol resin, or mixtures thereof. In embodiments, the crosslinked overcoat composition has an average modulus ranging from about 3 GPa to about 5 GPa, as measured by nano-indentation method using, for example, nanomechanical test instruments manufactured by Hysitron Inc. (Minneapolis, Minn.).

Charge Transport Layer

In embodiments, the charge transport layer comprises a hole transport molecule, a fluorinated diol, and a leveling agent. In embodiments, the fluorinated diol is a perfluorinated diol selected from the group consisting of perfluorinated 1,6-hexanediol, perfluorinated 1,8-octanediol, and perfluorinated 1,10-decanediol, although any other perfluorinated diol having intermediate lengths may be employed. Exemplary perfluorinated diols are shown in FIG. 1, along with an exemplary hole transport molecule. In embodiments, a weight percent ratio of the hole transport molecule to fluorinated diol is in a range from about 2:1 to about 0.8:1 or about 1:1. The CTL is formed from a composition that comprises these components typically in the presence of a volatile solvent, allowing the charge transport layer to form with a thickness from about 10 microns to about 40 microns, or from about 25 to about 35 microns.

In embodiments, the hole transport molecule comprises a core selected from the group consisting of triarylamines, hydrazones, and enamines. In embodiments, the hole transport molecule is a triarylamine. In embodiments, the triarylamine is N4,N4,N4',N4'-tetrakis(4-(methoxymethyl)phenyl)biphenyl-4,4'-diamine. Hole transport molecules may be include cores such as, for example, triarylamines, hydrazones disclosed in U.S. Pat. No. 7,202,002, and enamines disclosed in U.S. Pat. No. 7,416,824 with the following general structures:

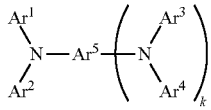

triarylamine

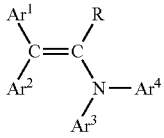

enamines

-continued

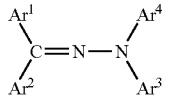

hydrazones

The segment core comprising a triarylamine being represented by the following general formula:

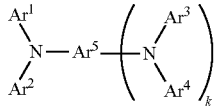

wherein $Ar^1$, $Ar^2$, $Ar^3$, $Ar^4$ and $Ar^5$ each independently represents a substituted or unsubstituted aryl group, or $Ar^5$ independently represents a substituted or unsubstituted arylene group, and k represents 0 or 1, wherein at least two of $Ar^1$, $Ar^2$, $Ar^3$, $Ar^4$ and $Ar^5$ comprises a Fg (previously defined). $Ar^5$ may be further defined as, for example, a substituted phenyl ring, substituted/unsubstituted phenylene, substituted/unsubstituted monovalently linked aromatic rings such as biphenyl, terphenyl, and the like, or substituted/unsubstituted fused aromatic rings such as naphthyl, anthranyl, phenanthryl, and the like.

Segment cores comprising arylamines with hole transport added functionality include, for example, aryl amines such as triphenylamine, tetraphenyl-1,1'-biphenyl)-4,4'-diamine, N,N'-diphenyl-N,N'-bis(3-methylphenyl)-(1,1'-biphenyl)-4,4'-diamine, N,N'-bis(4-butylphenyl)-N,N'-diphenyl-[p-terphenyl]-4,4''-diamine; hydrazones such as N-phenyl-N-methyl-3-(9-ethyl)carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like.

Molecular building blocks comprising triarylamine core segments with inclined hole transport properties may be derived from the list of chemical structures including, for example, those listed below:

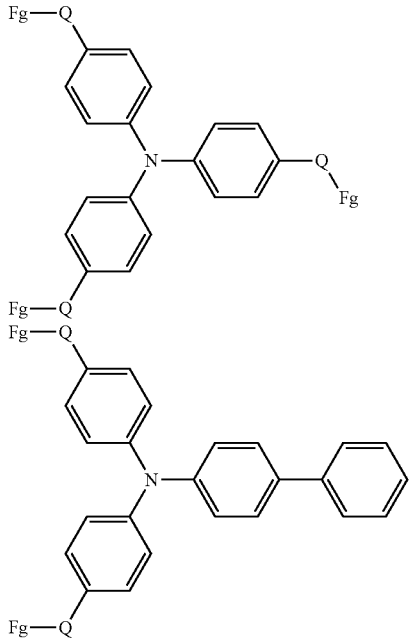

-continued

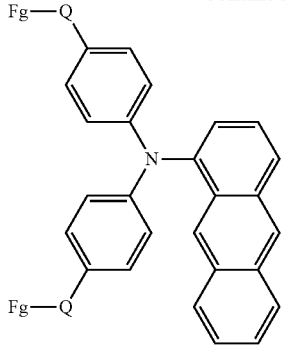

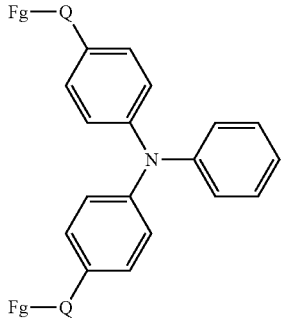

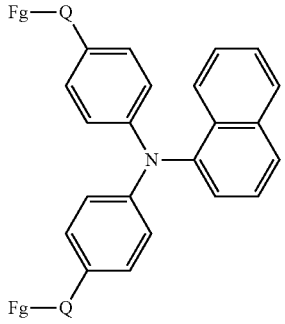

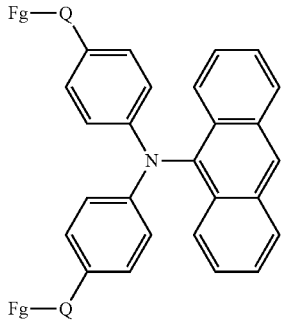

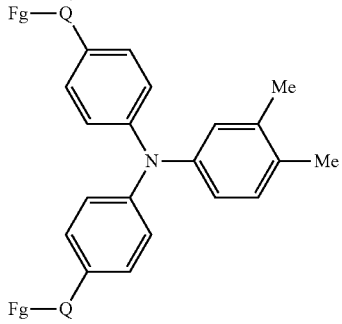

-continued

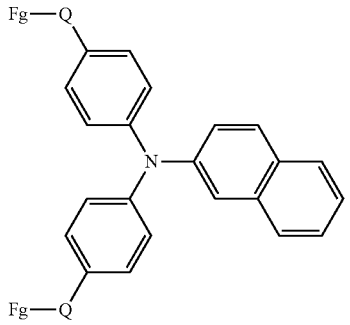

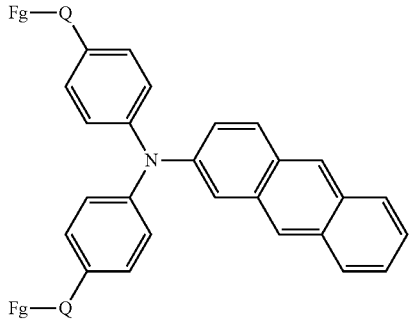

triarylamine cores

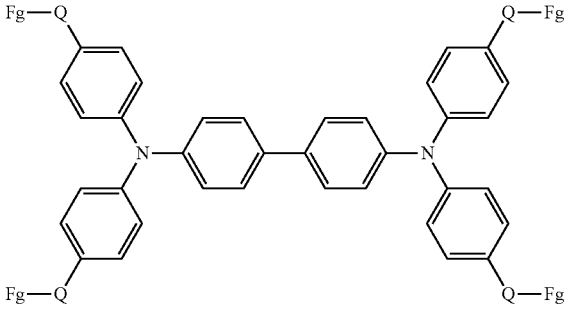

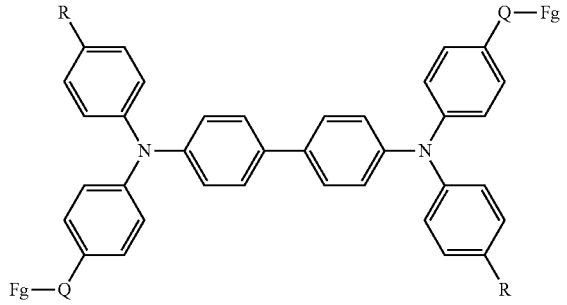

tetraarylbiphenylenediamine (TBD) cores

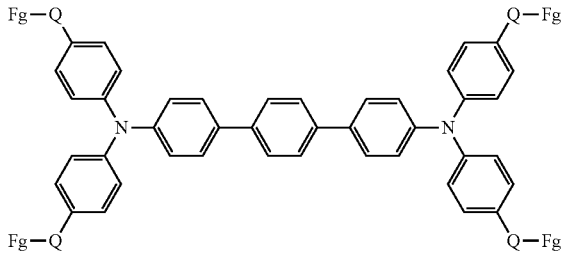

-continued

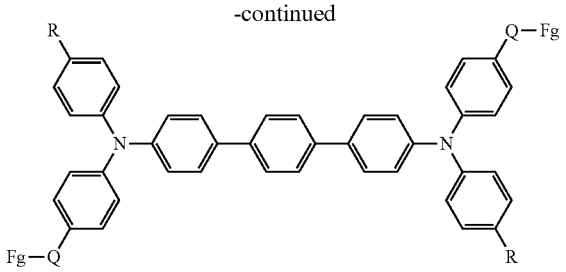

tetraarylterphenylenediamine (TER) cores

The segment core comprising a hydrazone being represented by the following general formula:

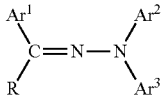

wherein $Ar^1$, $Ar^2$, and $Ar^3$ each independently represents an aryl group optionally containing one or more substituents, and R represents a hydrogen atom, an aryl group, or an alkyl group optionally containing a substituent; wherein at least two of $Ar^1$, $Ar^2$, and $Ar^3$ comprises a Fg (previously defined); and a related oxadiazole being represented by the following general formula:

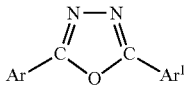

wherein Ar and $Ar^1$ each independently represent an aryl group that comprises a Fg (previously defined).

Molecular building blocks comprising hydrazone and oxadiazole core segments with inclined hole transport properties may be derived from the list of chemical structures including, for example, those listed below:

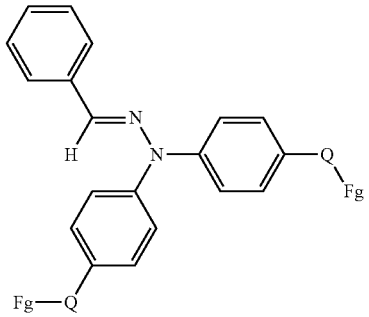

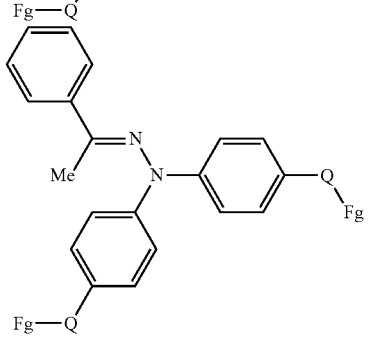

-continued

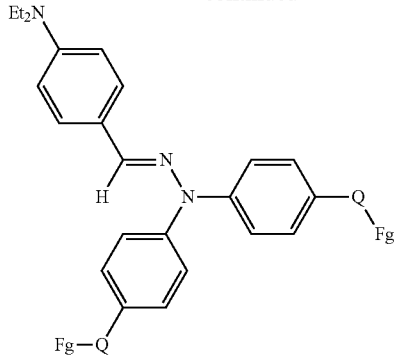

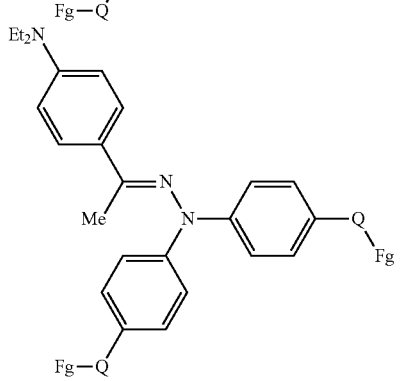

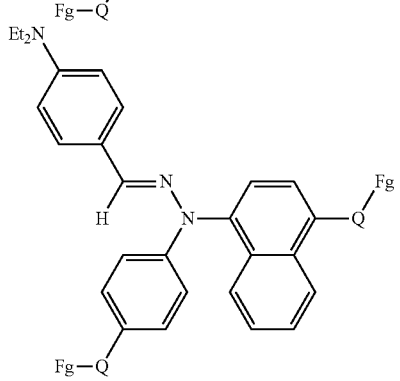

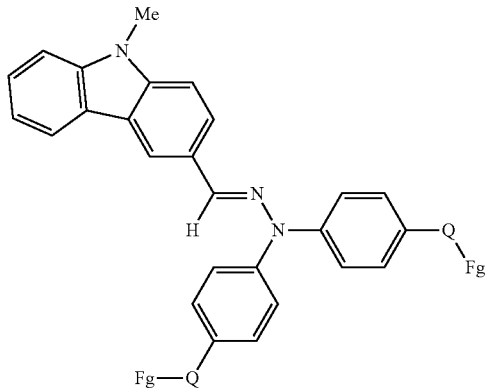

hydrazone cores

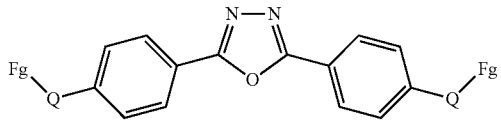

oxadiazole cores

The segment core comprising an enamine being represented by the following general formula:

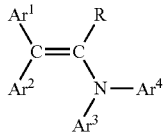

wherein $Ar^1$, $Ar^2$, $Ar^3$, and $Ar^4$ each independently represents an aryl group that optionally contains one or more substituents or a heterocyclic group that optionally contains one or more substituents, and R represents a hydrogen atom, an aryl group, or an alkyl group optionally containing a substituent; wherein at least two of $Ar^1$, $Ar^2$, $Ar^3$, and $Ar^4$ comprises a Fg (previously defined).

Molecular building blocks comprising enamine core segments with inclined hole transport properties may be derived from the list of chemical structures including, for example, those listed below:

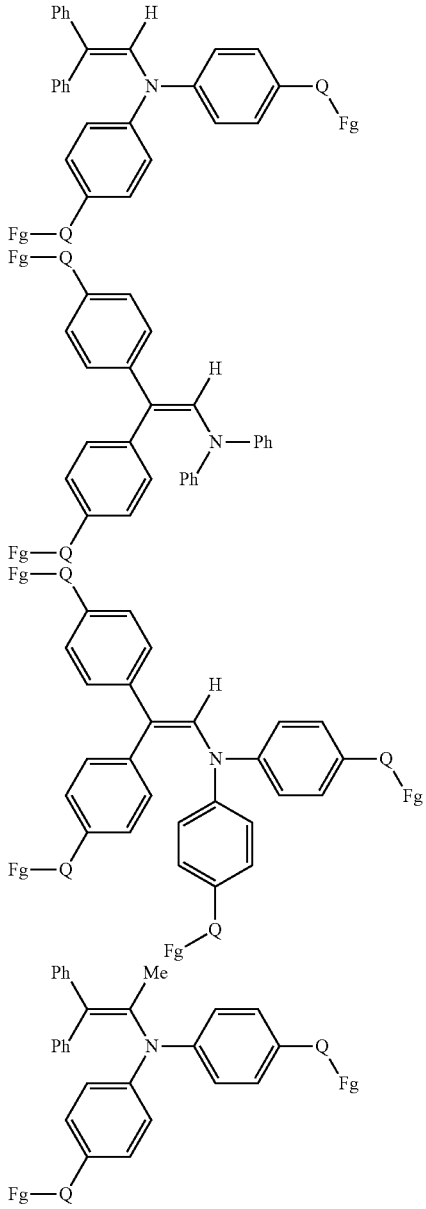

-continued

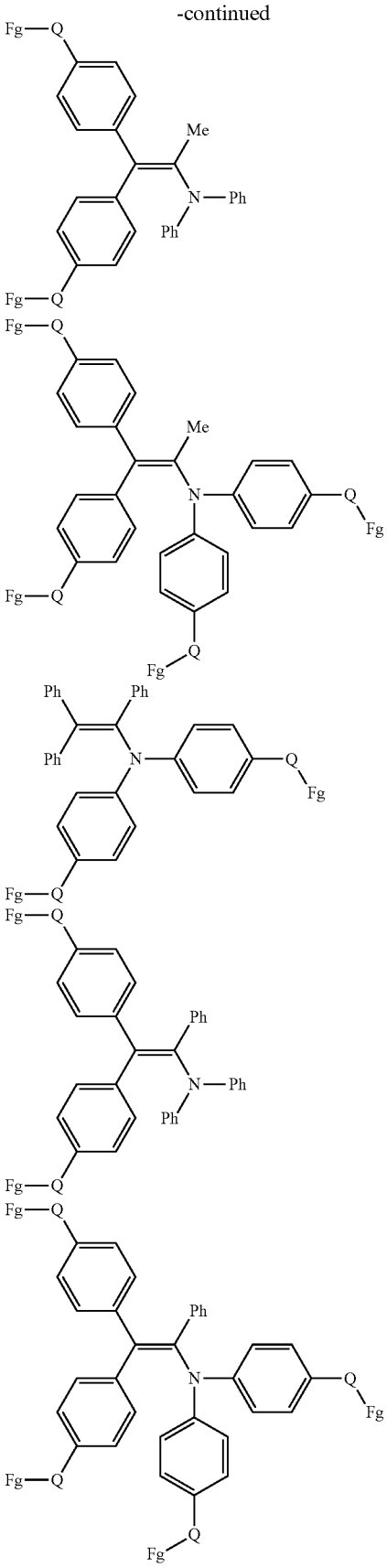

enamine cores

Electron transport functionality may be obtained by selecting segment cores comprising, for example, nitrofluorenones, 9-fluorenylidene malonitriles, diphenoquinones, and naphthalenetetracarboxylic diimides with the following general structures:

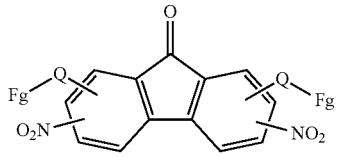

nitrofluorenones

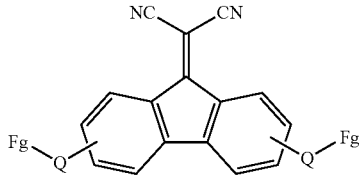

9-fluorenylidene malonitriles

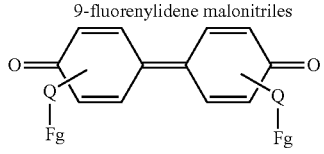

diphenoquinones

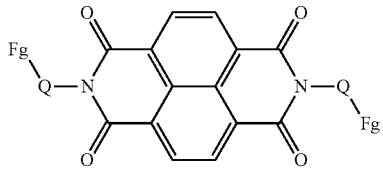

naphthalenetetracarboxylic diimides

In embodiments, the charge transport layer comprises a crosslinked portion distal to the charge generating layer. In embodiments, the crosslinked portion comprises a continuous gradient whereby the degree of crosslinking is greatest distal to the charge generating layer. Thus, in embodiments, there are provided photoreceptors comprising a substrate, a charge generating layer disposed on the substrate, and a charge transport layer disposed on the charge generating layer, the charge transport layer comprising a hole transport molecule, a fluorinated diol, and a leveling agent, wherein the charge transport layer comprises a gradient crosslinked portion whereby the degree of crosslinking is greatest distal to the charge generating layer.

Figure 3:
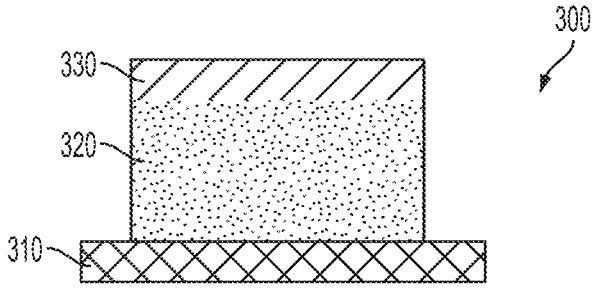
FIG. 3 shows the structure of a high speed photoreceptor having a CTL, in accordance with embodiments disclosed herein, wherein the surface of the CTL has been cross-linked via external treatment creating a gradient crosslinking at the surface of the CTL.

Referring now to FIG. 3, there is shown a photoreceptor 300 comprising a substrate 310 with a CTL 320 comprising a gradient crosslinked portion 330, in accordance with some embodiments. In embodiments, crosslinked portion 330 may comprise a thickness from about 10 nm to about 15 microns, or from about 1 micron to about 10 microns. Crosslinked portion 330 may confer wear resistance to the CTL and may obviate the need for a separate coated protective layer. In embodiments, crosslinked portion 330 has a hardness of about x to about y. Crosslinked portion 330 is accessible by modification of the CTL surface via treatments with 1) acid or base, (2) e-beam irradiation, (3) UV irradiation, (4) hydrogen bombardment, or (5) plasma treatment.

Thus, in embodiments, there are provided methods of forming charge transport layers disclosed herein, the methods comprising applying on a substrate a polymer binder-free and catalyst-free mixture comprising a hole transport molecule, a fluorinated diol, and a leveling agent; and curing the placed mixture. The cured mixture provides the requisite CTL. Where the CTL has a surface treatment, the curing (or post-curing) comprises an external surface treatment selected from the group consisting of (1) acid or base, (2) e-beam irradiation, (3) UV irradiation, (4) hydrogen bombardment, and (5) plasma treatment.

In embodiments, the charge transport layers disclosed herein are characterized as being free of polymer binders and catalysts, and have post-discharge voltages of less than about 10 volts. The post discharge voltage is measured using an electrostatic voltmeter and is an indication of the discharge speed of the photoreceptor at a given measurement time. A faster discharge speed enables faster printing and is thus an important parameter in determining the maximum print speed capability of the photoreceptor. Without being bound by theory, it has been postulated that the ability to form the CTL in the absence of conventional polymer binders and catalysts enhances the performance of the CTL.

In embodiments, the CTL may comprise further components such as leveling agents and antioxidants. Leveling agents may be selected to be volatile or not and may be present or not in the final cured CTL structure. Leveling agents may include mixtures of volatile and non-volatile components. Exemplary leveling agents may include hydroxyl-functionalized silicone modified polyacrylates such as SILCLEAN® 3700 (BYK, Wallingford, Conn.).

Other layers may be present in addition to those described above, such additional layers being disposed between or on top of the layers shown in FIGS. 2 and 3, as further described below.

Hole Blocking Layer

In embodiments, a hole blocking layer may be disposed on substrate 210 or 310. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$(gamma-aminopropyl) methyl diethoxysilane, as disclosed in U.S. Pat. Nos. 4,338,387, 4,286,033 and 4,291,110.

General embodiments of the undercoat layer may comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials may include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The hole blocking layer may be continuous and have a thickness of less than about 0.5 micrometer because greater thicknesses may lead to undesirably high residual voltage. A hole blocking layer of between about 0.005 micrometer and about 0.3 micrometer is used because charge neutralization after the exposure step is facilitated and optimum electrical performance is achieved. A thickness of between about 0.03 micrometer and about 0.06 micrometer is used for hole blocking layers for optimum electrical behavior. The hole blocking layers that contain metal oxides such as zinc oxide, titanium oxide, or tin oxide, may be thicker, for example, having a thickness up to about 25 micrometers. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

Charge Generation Layer

In embodiments there may be present a charge generation layer. Any suitable charge generation binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the charge generation layer, including those described, for example, in U.S. Pat. No. 3,121,006, the entire disclosure thereof being incorporated herein by reference.

Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In specific embodiments, the charge generation layer 18 may have a thickness of at least about 0.1 μm, or no more than about 2 μm, or of at least about 0.2 μm, or no more than about 1 μm. These embodiments may be comprised of chlorogallium phthalocyanine or hydroxygallium phthalocyanine or mixtures thereof. The charge generation layer 18 containing the charge generating material and the resinous binder material generally ranges in thickness of at least about 0.1 μm, or no more than about 5 μm, for example, from about 0.2 μm to about 3 μm when dry. The charge generation layer thickness is generally related to binder content. Higher binder content compositions generally employ thicker layers for charge generation.

The Anti-Curl Back Coating Layer

In embodiments, there may be provided an anti-curl back coating which may comprise organic polymers or inorganic polymers that are electrically insulating or slightly semiconductive. The anti-curl back coating provides flatness and/or abrasion resistance.

Anti-curl back coating may be formed at the back side of the substrate 210 or 310, opposite to the imaging layers. The anti-curl back coating may comprise a film forming resin binder and an adhesion promoter additive. The resin binder may be the same resins as the resin binders of the charge transport layer discussed above. Examples of film forming resins include polyacrylate, polystyrene, bisphenol polycarbonate, poly(4,4'-isopropylidene diphenyl carbonate), 4,4'-cyclohexylidene diphenyl polycarbonate, and the like. Adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film forming resin addition. The thickness of the anti-curl back coating is at least about 3 micrometers, or no more than about 35 micrometers, or about 14 micrometers.

EXAMPLES

Example 1

This Example shows the preparation of CTL-forming coating mixture.

The following method is exemplary for the formation a CTL coating composition. Referring to Table 1 for the quantities of reagents, the method commenced by adding the hole transport molecule (exemplified byTME-TBD, see FIG. 1) and perfluorinated diol12FOD into a jar with a stir bar. The mixture was heat at 110° C. for 30 minutes to melt 12FOD and dissolve TME-TBD making sure all solids were removed from the sides walls of the vessel and the TME-TBD dissolved into 12FOD. Next, Dowanol was added neat over 5 minutes (this can be done over 30 minutes to simulate having added an acid) at 110° C. SILCLEAN® 3700 was added and heating continued at 110° C. for 1 minute. The reaction mixture was then cooled to room temperature and solution filtered through a 5 micron filter. The solution was then ready to form a coating to cure and form a CTL.

TABLE 1

| Total volume | 20 mL | |
|---|---|---|
| Solids % wt of Solution | 40% | |
| Component: | wt % of Solids | Total Mass (g) |
| 12FOD | 51.55 | 4.0800 |
| TME-TBD | 47.25 | 3.7440 |
| SILCLEAN ® 3700 | 1.10 | 0.3520 |
| Dowanol PM | | 12.0000 |

Example 2

This Example shows the formation and characterization of the CTL with the CTL forming solution of Example 1.

The formulation shown in Table 1 and prepared in accordance with the procedure of Example 1 was coated onto PEN/TiZr/Silane/Ardel/HOGaPc photoactive substrate as a full thickness charge transport layer using a 8 mil blade gap. The device was cured at 120° C. for 20 minutes. The resulting charge transport layer was 30 microns thick, uniformly transparent, hard, and free of crystallization.

Figure 4:
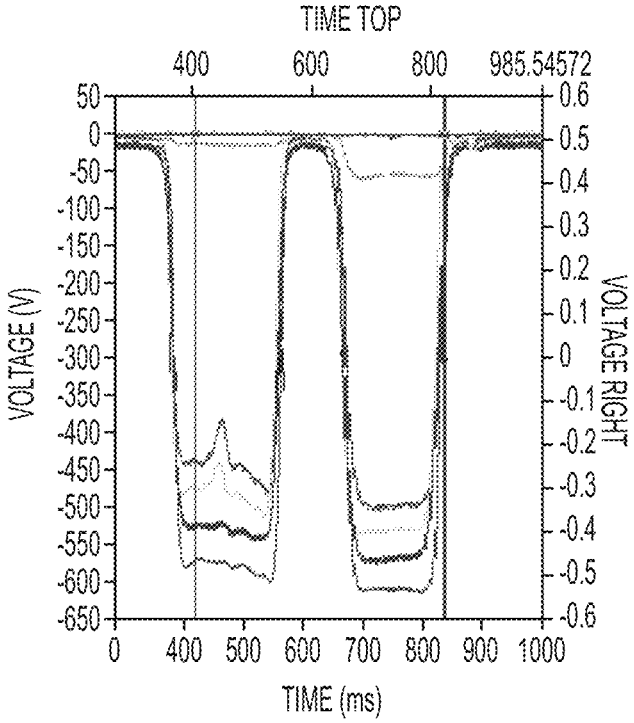
FIG. 4 shows Universal Drum Scanner (UDS) electrical evaluation of a TME-TBD-fluorinated diol full thickness charge transport layer versus a conventional charge transport layer comprising 40% m-TBD indicating improved high speed discharge of TME-TBD-fluorinated device.
Figure 5A:
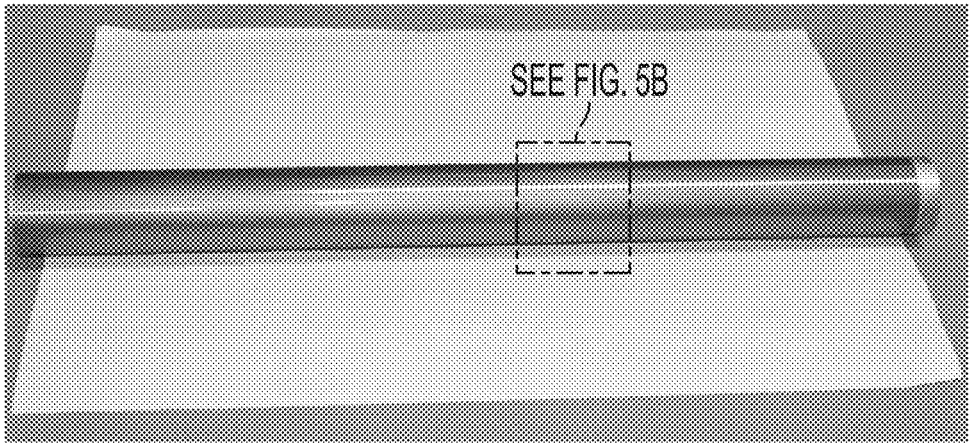
FIG. 5A shows a photograph (along with close-up FIG. 5B) of an aluminum drum coated with a TME-TBD-fluorinated diol without any polymer or catalyst present, in accordance with embodiments disclosed herein.
Figure 5B:
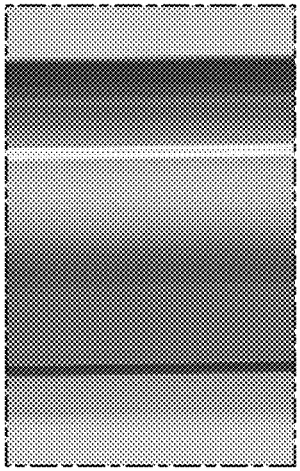

Evaluation of device was performed using a universal drum scanner. A conventional CTL control sample comprising 40% m-TBD charge transport molecule was used as a comparative example. Samples were mounted onto a 84 mm aluminum drum and grounded. The drum was rotated at 90 rpm. Devices were charged using a scorotron device and 780 nm light was used to discharge the devices. FIG. 4 shows the voltage traces of one cycle from the PIDCs. A dramatic improvement in photodischarge (post-discharge voltage) of the CTL formed with the solution of Example 1 was observed compared to the conventional CTL. The surface voltage of the TME-TBD+fluorinated diol device drops 46 volts lower than that of the conventional CTL.

Formulation from Example 1 was also coated onto 30 mm aluminum drum with using Tsukiagi cup coating technique. Base aluminum drum and photoreceptor was a Hodaka F469 configuration: F469—Fuji Xerox OPC production photoreceptor comprising 3 comp UCL/PC5 CGL/m-TBD+AE18+PCZ300 CTL.

Coating parameters
Pull rate mm/min=200
Curing time @ 155° C.=20 min

The TME-TBD+Fluorinated diol combination can be readily cross-linked into a structured organic film using well know acid or base catalysts mixed into the coating solution and cured with heat (U.S. Pat. No. 8,247,124). However, since this affects the entire thickness, it significantly lowers the charge carrier average mobility through the device.

In accordance with embodiments disclosed herein it is preferable that no catalyst is present in the coating solution to provide high charge carrier average mobility and excellent charge discharge characteristics when used as a CTL. Cross-linking externally to only the uppermost surface layer may be effected. This can provide a robust low wear, low surface energy, surface while also having relatively high charge carrier average mobility. In order to introduce cross-linking to only the surface layer the following treatments may be used external treatments post coating: 1—Acid or base solution treatment 2—e-beam 3—UV light 4—$H_2$ bombardment 5—Plasma. A CTL has been modified using $H_2$ bombardment (U.S. Application 20110324) with success, although the CTL has not yet been characterized.

A CTL has been modified by method 1 as described here. Coatings of TME-TBD and fluorinated diol from Example 1 were used to form an uncured CTL without any catalyst. The CTL was then externally washed with a diluted solution of Nacure 5225 and then cured at 155° C. The resulting coatings passed solvent tests with THF and Acetone. They were then submitted for IR. The ATR-IR spectrum of the film exhibits a weak, broad peak centered around 3400 $cm^{-1}$. The observation of a weak stretch between 3000-3500 $cm^{-1}$ is consistent with residual acid catalyst on the surface of the coating. As O—H stretching modes typically exhibit strong IR absorption, the peak is not believed to be indicative of residual O—H functionality or solvent (assuming you coated from alcohol solvent) as it is very weak relative to neighboring alkane C—H stretching modes. This data suggests that while cross-linking occurs, this method may benefit from further treatments to eliminate the residual acid catalyst. Alternatively, other radiative methods such as e-beam or $H_2$ bombardment may be more advantageous.

What is claimed is:

1. A photoreceptor comprising:
a substrate;
a charge generating layer disposed on the substrate; and
a charge transport layer disposed on the charge generating layer, the charge transport layer comprising:
a hole transport molecule;
a fluorinated diol; and
a leveling agent;
wherein the charge transport layer is substantially free of a polymer binder and catalyst, and has a post-discharge voltage of less than about 10 volts.

2. The photoreceptor of claim 1, wherein the photoreceptor further comprises an overcoat layer disposed on the charge transport layer.

3. The photoreceptor of claim 1, wherein the charge transport layer comprises a crosslinked portion distal to the charge generating layer.

4. The photoreceptor of claim 3, wherein the crosslinked portion comprises a continuous gradient whereby the degree of crosslinking is greatest distal to the charge generating layer.

5. The photoreceptor of claim 1, wherein the hole transport molecule comprises a core selected from the group consisting of triarylamines, hydrazones, and enamines.

6. The photoreceptor of claim 5, wherein the hole transport molecule is a triarylamine.

7. The photoreceptor of claim 6, wherein the triarylamine is N4,N4,N4',N4'-tetrakis(4-(methoxymethyl)phenyl)biphenyl-4,4'-diamine.

8. The photoreceptor of claim 1, wherein the fluorinated diol is a perfluorinated diol selected from the group consisting of perfluorinated 1,6-hexanediol, perfluorinated 1,8-octanediol, and perfluorinated 1,10-decanediol.

9. The photoreceptor of claim 1, wherein a weight percent ratio of the hole transport molecule to fluorinated diol is about 1:1.

10. The photoreceptor of claim 1, wherein charge transport layer has a thickness from about 10 microns to about 40 microns.

* * * * *